US005118116A

United States Patent [19]

Cherni

[11] Patent Number: 5,118,116

[45] Date of Patent: Jun. 2, 1992

[54] DART PRACTICE AND GAME APPARATUS FOR USE WITH A DART BOARD

[76] Inventor: Richard Cherni, 1175 Gary Blvd., Brunswick, Ohio 44212

[21] Appl. No.: 625,034

[22] Filed: Dec. 10, 1990

[51] Int. Cl.[5] ..... F41J 3/00

[52] U.S. Cl. ..... 273/408

[58] Field of Search ..... 273/408

[56] References Cited

U.S. PATENT DOCUMENTS 1,076,002 10/1913 Clarke ..... 273/408 X 4,948,148 8/1990 Danielson ..... 273/408

*Primary Examiner*—William H. Grieb

*Attorney, Agent, or Firm*—Oldham & Oldham Company

[57] ABSTRACT

The invention describes a dart target device for use with a dart board. In the preferred embodiment, the dart practice device is attached to the bullseye of the dart board and can be rotated around the dart board to overlie different numbered target segments of a dart board. This device may be utilized as a practice device to help a user to become more proficient at hitting the doubles and triples rings of the dart board as well as the bullseye. Alternatively, the device may be provided with various target zones thereon, which would allow the user to play various dart games therewith. The device includes mechanisms to secure it to the dart board at the desired orientation thereon. There also may be included a mechanism to selectively rotate the device on the dart board automatically, to facilitate throwing practice or to provide alternative games to be played with the device.

20 Claims, 3 Drawing Sheets

DART PRACTICE AND GAME APPARATUS FOR USE WITH A DART BOARD

TECHNICAL FIELD OF THE INVENTION

This invention generally relates to a practice and game apparatus for use with a dart board. More particularly, this device helps one to concentrate on a particular area of the dart board to become more accurate when throwing the dart at the target or alternatively serves as a means by which a variety of games may be played using the dart board.

BACKGROUND OF THE INVENTION

The game of darts is played throughout the U.S. and the world by young and old. This game can be competitive or simply a leisure time activity. The game of darts is normally played with a set of three darts, which are intended to be thrown against a target, and scoring is achieved from the placement of the thrown darts on the target. A very proficient player can throw a number of darts into an area as little as one-quarter of an inch square, which is the type of accuracy required to obtain the highest scores. The small target area in which the throws are desired to be placed creates a problem to the player throwing darts.

From its early origins in the middle ages when English bowmen threw shortened versions of their arrows at wine casks, the game of darts has had a special allure to all who try it. Although the game originated in Britain and virtually every pub now has a dart board, darts are played throughout the world by millions of people from all walks of life—from doctors and lawyers to housewives and construction workers.

It is a game of skill and concentration and does not require physical strength or unusual coordination. Anyone can be develop the throwing skills to become proficient with practice and by mastering basic principles.

The earliest dart boards were made from elm logs. Some are still used today, but they must be soaked daily. Boards of compressed paper or composition are inexpensive and suitable for occasional use. However, a bristle dart board assembled from millions of fibers bound together heals itself after each thrown dart, and withstands constant use in tournament competition or the home recreation room.

The board is hung on the wall so that the center of the bullseye is exactly 5 feet 8 inches from the floor. The throwing line or hockey is 7 feet 9 ¼ inches from the board. The board is divided into pie shaped segments numbered 1 through 20 and the center bull. There are also two narrow rings, the outer ring counting for double the indicated number for that segment, and the inner ring counting for triple the indicated score. The bullseye area counts for 25, with the inner bull counting as a double or 50.

It is understood that a beginner at this game will be hard pressed to throw a dart into a particular area to score points because the smaller the area hit by the dart, the greater the number of points scored which is the object of the game. In order to become proficient at dart throwing, one must practice. Normally, such practice will comprise repeated attempts to place the thrown darts in the double, triple or bullseye sections of the dart board within will give a beginner or experienced person practice in areas of the board in which he wants to become more proficient at hitting.

Although there are various target structures which have been developed to address or create other games, there has not been developed a target structure for dart boards which allows the users to more effectively practice throwing and improves the ability to focus on particular areas of the dart board. Similarly, there are not know any game apparatus for use with a dart board, which allow the dart board to be used to play a variety of different games.

SUMMARY OF THE INVENTION

Based upon the foregoing, there has been found a need to provide a target apparatus which may be used in conjunction with a dart board to allow the user to more effectively practice throwing or to allow different games to be played therewith. It is therefore a main object of the invention to provide a target structure which is adapted to be selectively positioned on a dart board to enable the user to improve their accuracy when throwing darts, or to provide a means by which the user may play a variety of different games using the dart board.

It is a further object of the present invention to provide a target apparatus to improve ones accuracy or to allow the playing of different games selectively to allow full access to the dart board.

It is a further object of the invention to provide a target structure which is cost effectively manufactured and is easily positioned on a dart board to provide an effective target structure to practice throwing skills or to play a variety of dart games using the device.

It is another object of the invention to provide a target structure which includes target zones which allow the user to more effectively improve ones throwing accuracy.

It is a further object of the invention to provide a target structure which is usable as a practice device and/or a gaming device which allows the user to play a variety of games other than those normally associated with a dart board.

It is yet another object of the invention to provide a target structure which allows the user to variably position the target by rotation on the dart board to facilitate practicing of throwing skills.

These and other objects of the invention are achieved by means of a target structure which comprises a shaped member which is movably positioned on the surface of a dart board to essentially become an integral portion of the throwing surface thereof. The target structure includes a variety of target zones provided thereon which may simulate the target zones of the dart board itself or may provide additional target zones which allow a variety of different games to be played with the dart board. In the preferred embodiment, the target structure may be a wedge-shaped member with a first and second end, having the first end positioned adjacent or coinciding with the bullseye or center of the dart board and its second end extending towards the periphery of the dart board, simulating the wedge-shaped target zones of the dart board itself. The target structure may be rotated on the dart board for repositioning thereof at any selected orientation on the dart board, with the second end being secured and retained in the desired position in an easy and effective manner. Various means for rotatably positioning the target structure on the dart board are provided, which allows the device to be easily used with the dart board when desired, or to be removed for use of the dart board alone. There may also be provided means for automatically repositioning the target structure on the dart board by allowing continuous or intermittent rotation of the target structure to provide a unique darting game or to facilitate practice with the device.

BRIEF DESCRIPTION OF DRAWINGS

These and other objects and advantages of the present invention will become more readily apparent from the more detailed description of the preferred embodiments taken in conjunction with the drawings, wherein.

DETAILED DESCRIPTION

Figure 1:
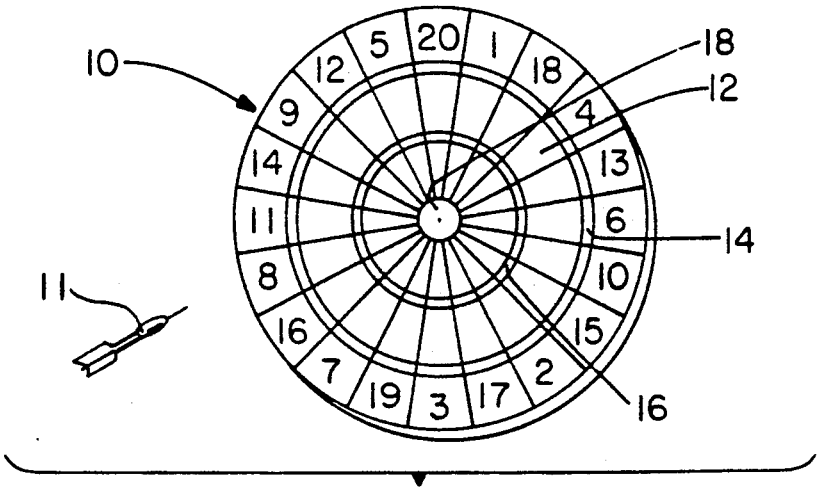
FIG. 1 is a perspective view of a conventional dart board.

Referring now to the FIG. 1, a conventional dart board 10 is shown which may be a bristle dart board of the like. The dart board 10 includes a number of individual wedge-shaped target areas 12 which are printed on the dart board 10 as an example. Normally, twenty of the wedge-shaped zones 12 are provided with each numbered and positioned at relatively random places on the board 10. In each of the wedge-shaped zones 12, there are provided additional target zones, such as a doubles ring 14 and a triples ring 16, each having very small widths, and being provided a predetermined radial distance from the center of the dart board 10. At the center of the dart board is an additional bullseye target 18 which may comprise an outer single bullseye ring and a small inner circular zone being a double bullseye. Normally, each of the target regions defined in each of the wedge-shaped zones 12 are separated by means of wires so as to clearly define the target zone relative to an imbedded point of a dart.

With this structure of the dart board 10, conventional darting games comprise various methods of hitting and scoring in each of the target zones provided on the dart board 10 using a dart 11. For example, the most popular games are the games of "301", "501" and "cricket" which rely upon basic principles of subtraction and the number values associated with each of the wedge-shaped regions 12 as well as the target zones therein. In the game of "301" for example, before any score is counted, the player must begin by hitting a double in the zone 14 of any of the wedge-shaped regions 12 or the double bullseye 18 at the center of the dart board 10. Upon each subsequent throw of a dart, the face number value of the wedge-shaped region 12 which has been hit by the dart 11 is subtracted from the number "301" or the remainder. If the doubles ring 14 or triples ring 16 are hit, the number value of the wedge-shaped portion 12 is doubled or tripled respectively, and subtracted from the score. The other games mentioned are variations upon this basic theme, and other games are certainly playable using this configuration of dart board 10.

It should be evident based upon the foregoing, that by hitting the doubles ring 14 or triples ring 16 or bullseye 18, the player can score more effectively in any of the above mentioned games.

Figure 2:
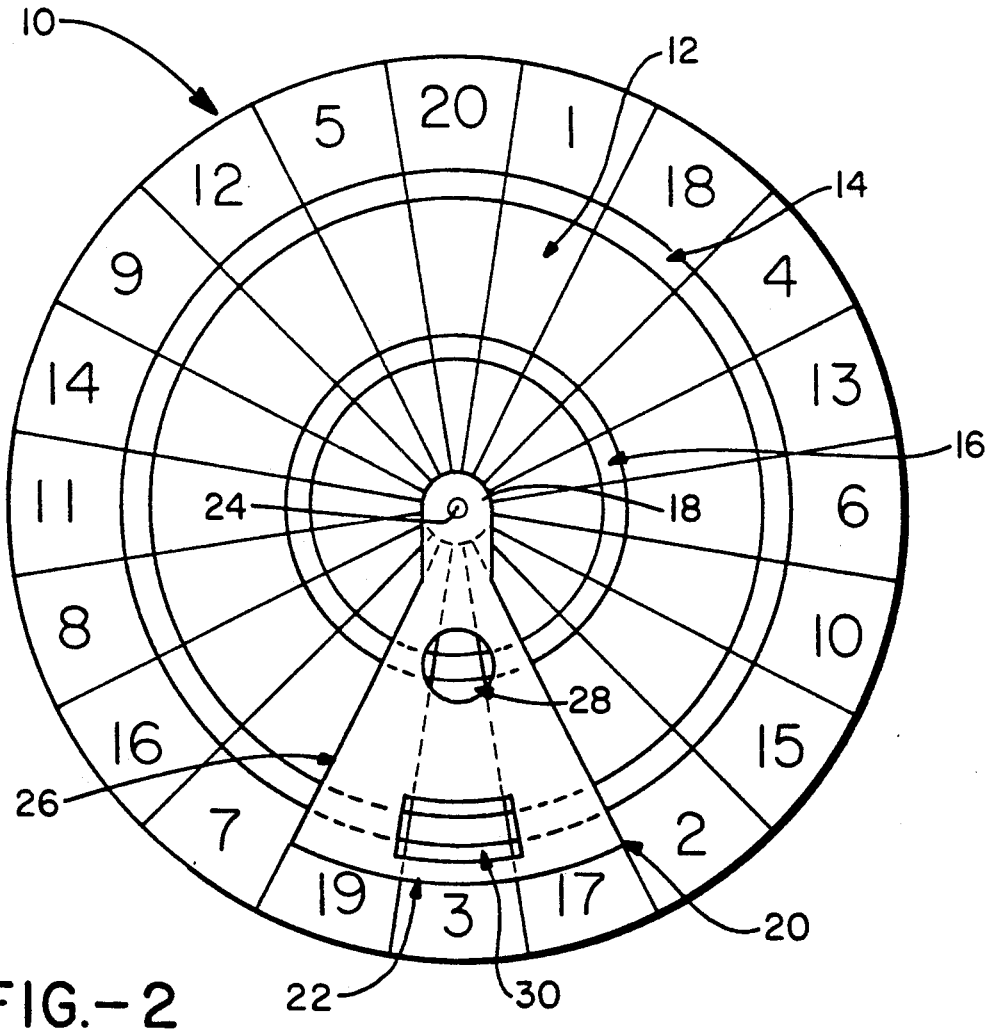
FIG. 2 is a plan view of a dart board with the target structure of the invention installed thereon.
Figure 3:
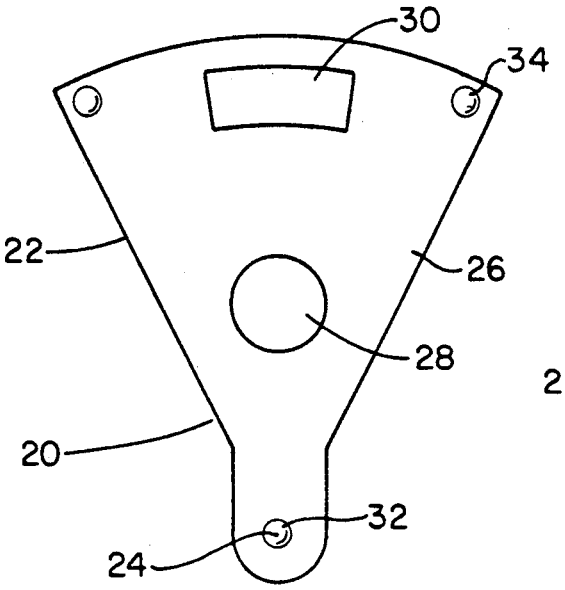
FIG. 3 is a plan view of the target structure of the invention showing some particular aspects thereof.

The target device of the invention will be described with reference to FIGS. 2 and 3, wherein, the device 20 of the invention comprises a body member 22 having first and second ends with the first end adapted to be secured at the center of the dart board 10 or at the location of the bullseye 18 as shown at 24. The body member 22 is adapted to be rotated about the point 24, so as to be positioned to overlie any of the wedge-shaped portions 12 of the dart board 10. The body member 22 is also generally wedge-shaped, and in the preferred embodiment has an outer portion 26 which is dimensioned to extend over three of the individual wedge-shaped portions 12 of the dart board 10. The body member 22 will therefore provide a discrete target area which may be thought of as a single wedge-shaped region on the dart board having dimensions significantly larger than the wedge-shaped portions 12 thereof. For use as a practice device, the body member 22 may be provided with several target regions thereon, which as seen in this embodiment may comprise a first region 28 and second region 30 which are formed at the location of the center wedge-shaped region 12 over which the body member 22 lies. The target regions 28 and 30 may comprise apertures stamped in body member 22 to reveal the double and triple rings 14 and 16 of board 10, or may simply be printed on the surface of body member 22 as a colored region. The target region 28 in the preferred embodiment comprises a circular shaped zone having the dimensions similar to the bullseye 18 of the dart board but positioned to overlie the triples ring 16 of dart board 10. The target region 28 will desirably have approximately the same width dimensions of the triples ring 16 of the wedge-shaped portion 12 over which body member 22 lies, but will also have an area extending beyond the triples ring 16 so as to provide a slightly larger target then the actual triples ring for the thrower to concentrate on. Similarly, the target region 30 may be a wedge-shaped region corresponding to the shape of the doubles ring 14 of the wedge-shaped region 12 over which body member 22 lies. The target region 30 may be configured to have a substantially equivalent width to the doubles ring 14, but may be dimensioned to provide a larger target zone than the actual doubles ring 14 as seen in FIG. 2. In the preferred embodiment, the target region 30 may be dimensioned to be approximately twice the dimensions of the doubles ring 14 with one half of its radial thickness extending both toward and away from the center of the dart board 10 about doubles ring 14. The outer periphery of body member 22 is shaped to correspond to the outer periphery of the dart board 10, and may be configured so as not to overlie the numbers of the wedge-shaped portions 12 over which the body member 22 extends. Alternatively, to provide more target area about target region 30 on the device 20, the outer region of the body member 22 may be extended to the periphery of dart board 10. The target zones 28 and 30 may simply be printed on the surface of body member 22 or may comprise apertures in body member which reveal the double and triple rings 14 and 16 of board 10.

It should be recognized that the body member 22 provides a relatively large discrete target area which may include one or more discrete target regions thereon. The device 20 will facilitate enabling a user to concentrate and focus on the desired targets of the dart board 10. The formation of target regions on the body member 22 which conform in part to the desired doubles or triples ring of the dart board, but which have slightly larger areas, will facilitate the ability of the thrower to practice the accuracy of throws, especially toward these regions. The body member 22 may comprise a similar bristle material that the dart board 10 is constructed of to allow the device 20 to "heal" itself after each thrown dart so as to withstand constant use and provide a durable construction. Alternatively, the device 20 may be constructed of another type of material such as cork, cardboard or coiled paper material if desired. The device 20 is easily positioned at any desired location on the dart board 10 by rotating body member 22 about point 24 so as to allow the user to practice throwing for any particular wedge-shaped region 12 of the dart board 10. Thus, the device 20 must have the ability to be rotationally secured at point 24 to the dart board 10 and further secured at its outer or second end to maintain a desired position until a change is desired by the user.

Figure 4:
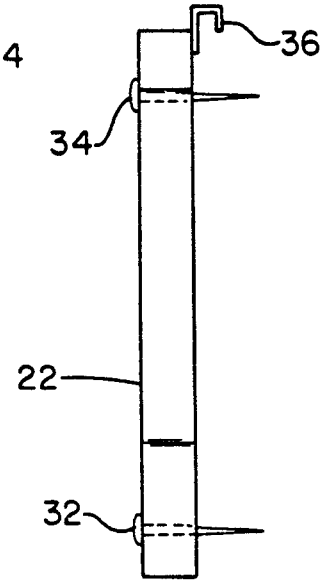
FIG. 4 is a side elevational view of the target structure as seen in FIG. 3, with means for securing the target structure on a dart board shown therewith.

As seen in FIG. 4, in a simple embodiment, the device 20 may be rotationally secured at point 24 at the center region of the board 10 by means of a tack 32 which will extend into the dart board 10 to anchor body member 22 thereon. At an upper portion of body member 22 may be provided one or more additional tacks 34, which may be selectively withdrawn from a dart board engaging position as seen in FIG. 4 to a non-engaging position which will allow the body member 22 to be easily rotated to any desired position about point 24 at tack 32. When the next desired position is located, the tacks 34 may then be reinserted into the dart board 10 to maintain this position of body member 22. In an alternative embodiment, the body member 22 may be attached at its outer or second end to the dart board by means of a clip or hook 36 which is adapted to engage either the outer surface of dart board 10 or a wire found on the front surface of the dart board 10 which delineates one of the wedge-shaped regions 12 or target regions thereof. The clip 36 may be pivotably attached to body member 22 on a back surface thereof, to allow the clip 36 to be rotated for engagement with dart board 10 to secure body member 22 at the desired position.

Figure 5:
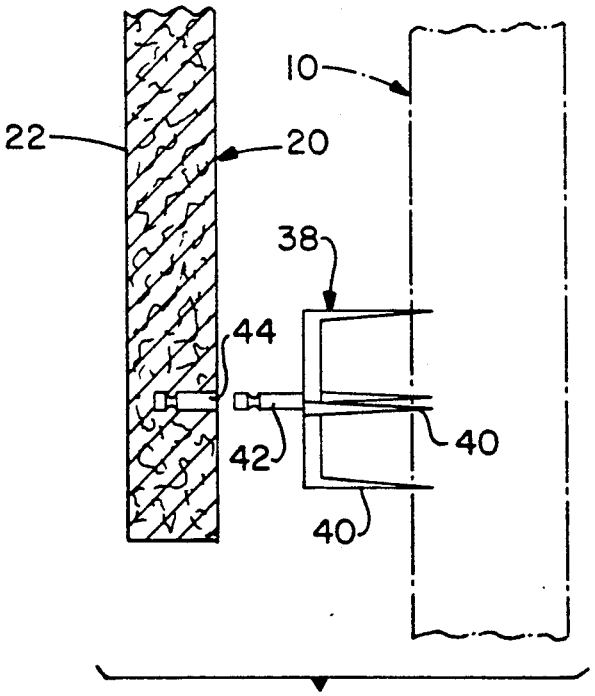
FIG. 5 is a partial side elevational view of an alternative embodiment of the means to secure the target structure of the invention to a conventional dart board.

Turning now to FIG. 5, an alternate embodiment of the securing means for body member 22 at point 24 is shown. It has been recognized that the use of a tack 32 in the previous embodiment may result in deterioration of the center region of the dart board 10 upon repeated insertion and removal of the tack 32 therefrom. Therefore, it may be desirable to provide an anchoring mechanism which will allow the device 20 to be easily secured in its proper position on dart board 10, but will not result in deterioration of dart board 10. In this embodiment, an anchoring means 38 may comprise a body member of circular or other configuration, which includes a plurality of fingers or anchoring pins 40 adapted to be inserted into dart board 10 for anchoring of means 38 at the desired location thereon. Each of the plurality of anchoring pins 40 will extend into dart board 10 adjacent a center region of the dart board 10, but will not be repeatedly placed in the same location upon use of device 20 with dart board 10. Thus, the surface area over which the device 20 is anchored to dart board 10 is spread out significantly from that of a single pin as in the previous embodiment. The anchoring means 38 may also comprise an outwardly extending engaging pin 42 which will coact with a receiving member 44 formed in body member 22 of device 20. The retaining pin 42 and receiving member 44 work together to allow body member 22 to be rotationally secured to anchoring means 38 as desired. Any suitable retaining pin 42 and corresponding receiving member 44 may be utilized to allow the body member 22 to be readily supported and secured in the desired position as well as to allow rotational movement thereof.

Figure 6:
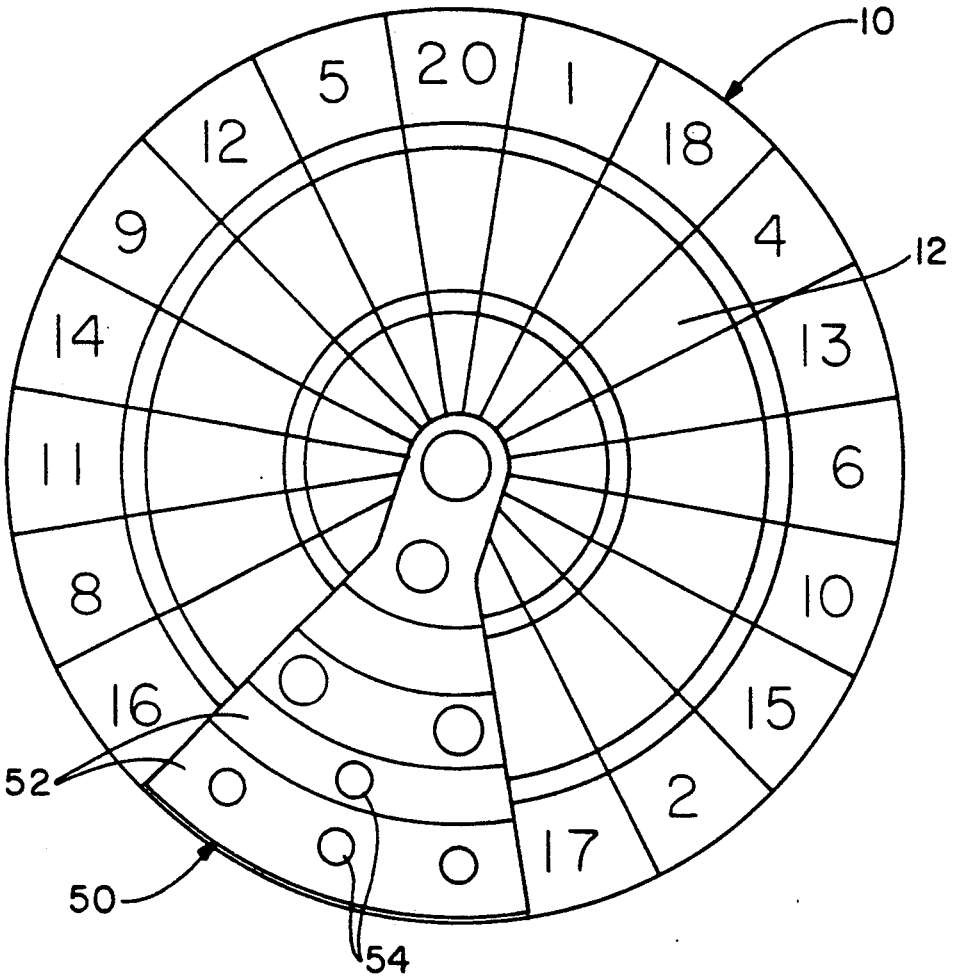
FIG. 6 is a plan view of an alternative embodiment of the invention as positioned on a dart board.

In an alternative embodiment as seen in FIG. 6, the device 50 is designed to provide a target device which may be used to practice throwing accuracy, but may also be utilized to play a wide variety of different darting games. The device 50 may be similarly shaped to the embodiment as previously described, or may comprise any desired shape to conform to a particular darting game to be played with the device. The device 50 may include a large number of discrete target zones which may comprise colored bands 52 or colored circular regions 54 as seen in FIG. 6. Each of the target bands 52 or target circles 54 may be differently dimensioned or configured in any desired manner to provide a plurality of discrete unique target zones at which the thrower may aim to achieve various goals of a particular darting game. For example, by configuring the device 50 to have a number of discrete target regions as seen in FIG. 6, a game simulating baseball may be played using the device 50. Each of the discrete target zones on device 50 may represent a hit, strike out, or the like with the smaller and harder to hit target regions representing extra base hits or home runs as an example. Thus, the player who can most accurately throw a dart to a given region can score more effectively in such a game. It should be recognized that this is only one example of a large variety of different games which may be developed using the target device of the invention. As other examples, a darting golf game may be played using the number values of the wedge-shaped regions 12 corresponding to holes 1 through 18 of a golf course. Discrete target zones on the target device 50 may similarly represent particular scores such as par, birdie, or the like, with scoring accomplished by hitting each of these zones. A round of 18 holes may be played by rotating the device 50 on the dart board 10 corresponding to the numbered wedge-shaped portions 12 thereof. As any target regions may be provided on the target device of the invention, individualized games may be developed or alternatively target zones may be provided which will generally represent a variety of different scoring functions for different types of games.

Figure 7:
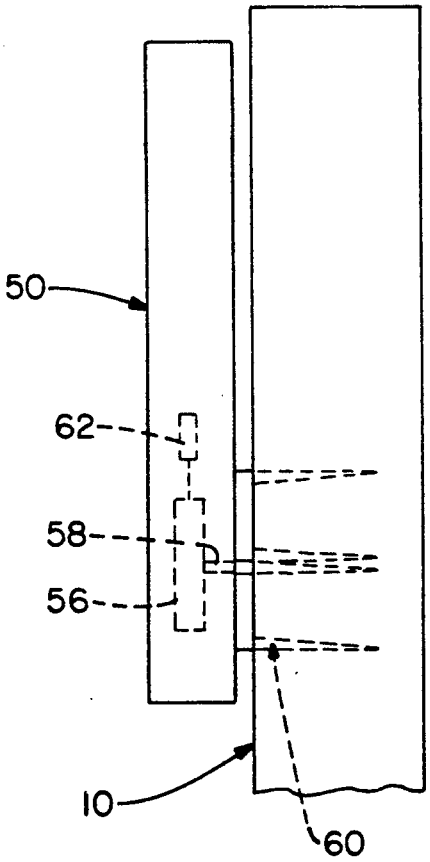
FIG. 7 is a partial side elevational view of the alternate embodiment as shown in FIG. 6.

In another aspect of the invention as seen in FIG. 7, the target device 50 may be provided with means to affect selective rotation of the device 50 around the dart board 10. For example, a small motor 56 may be integrated into the construction of the target device 50, which includes a driven output shaft 58 extending outwardly from the back of device 50. The driven output shaft of 58 is secured to a retaining means 60 which is in turn secured to the dart board 10, such that upon operation of motor 56 and rotation of the driven output shaft 58, the device 50 will be made to rotate about the driven shaft 58. The operation of the motor 56 may be selectively controlled by the user or may be provided with control logic means 62 which will allow various schemes for selectively rotating the device 50 on dart board 10. As an example, the device 50 may be used as a target practice device wherein operation of motor 56 will be actuated intermittently. This will act to rotate the device 50 in a predetermined manner to selectively position the target device 50 at various locations automatically giving a different target for the thrower after a predetermined amount of time. As still another example, operation of the motor may occur continuously to provide a continuously rotating device 50 which may be used to play a unique and exciting darting game therewith. Additionally, the motor 56 may be a reversible motor wherein drive shaft 58 will be selectively rotated in either direction depending on the desired aspects of a particular darting game or practice scheme as desired. For example, if the device 50 is continuously rotated on dart board 10, the chance that a dart will be thrown into dart board 10 at a point other than the location of the device 50 is likely, and upon continued rotation of device 50, such a dart will hinder rotation of the target 50 on dart board 10. In such a situation, the control logic means 62 may be configured to affect reversed rotation of output shaft 58 upon encountering resistance such as a dart thrown into dart board 10 so as to allow continued rotation of device 50. It should be recognized that a large variety of unique darting games may be developed using a continuously or intermittently rotating device to allow increased enjoyment by the user.

Having shown and described the preferred embodiments of the present invention, further adaptations of the dart device can be accomplished by appropriate modifications which would be obvious to one skilled in the art. Such modifications or alterations may be accomplished without departing from the scope of the present invention, and therefore it is understood that the invention is not to be limited to the details of the structure and operation described, but rather is to be measured by the scope and spirit of the appended claims.

What is claimed is:

1. A dart target device adapted to be used in conjunction with a dart board comprising:

a body member having first and second ends, with said first end including means to selectively rotatably secure said body member to a dart board, and said body member having at least one target area thereon, wherein said at least one target area is positioned to correspond to a double or triple scoring area formed on said dart board and said target area corresponding to said double or triple scoring area is dimensioned to be larger than the actual double or triple scoring target area of said dart board.

2. The dart target device according to claim 1 wherein, said body member comprises a substantially wedged shaped member having dimensions corresponding to a plurality of wedge-shaped target areas formed on said dart board, such that said body member will overlie said plurality of target areas on said dart board when said body member is secured to said dart board.

3. The dart target device according to claim 2, wherein, said body member has dimensions corresponding to at least three of said wedge-shaped target areas formed on said dart board.

4. The dart target device according to claim 1, wherein, said at least one target area is an aperture stamped in said body member to enable viewing of the portion of said dart board over which said aperture lies.

5. The dart target device according to claim 1, wherein, said body member includes at least two target areas thereon, a first of said target areas on said body member positioned to correspond to said double scoring area of said dart board, and the second of said target areas of said body member positioned to correspond to said triple scoring area of said dart board, with each of said first and second target areas dimensioned to be larger than the actual target double or triple scoring target areas of said dart board.

6. The dart target device of claim 1, wherein, the body member is constructed of a bristle material which acts to heal itself after being pierced by a dart so as to withstand constant use and provide a durable construction.

7. The dart target device according to claim 1, wherein, said body member is constructed of a cork material.

8. The dart target device of claim 1, wherein, said means to selectively rotatably secure said body member to said dart board comprises a tack extending from the back surface of said body member adapted to be inserted into said dart board at the desired location to selectively secure said body member to said dart board and to allow rotation of said body member about said tack.

9. The dart target device as in claim 1, wherein, said means to selectively rotatably secure said body member to said dart board comprise an anchoring means including a body member having a plurality of anchoring pins adapted to be inserted into said dart board, with said anchoring means further including an outwardly extending engaging pin adapted to be received and secured within a receiving means formed in said body member, such that said anchoring means may be secured to said dart board and said body member secured to said engaging pin of said anchoring means with said body member being rotatable relative to said anchoring means.

10. The dart target device according to claim 1, further including, a second securing means associated with said second end of said body member adapted to selectively engage said dart board at said second end to maintain the position of said second end at the desired rotational position of said body member.

11. The dart target device according to claim 10, wherein, said second securing means comprises at least one tack positioned adjacent said second end and adapted to be selectively placed in a dart board engaging position or non-engaging position to allow selective rotation of said body member on said dart board and to secure said second end to said dart board when said body member is positioned at the desired rotational orientation relative to said dart board.

12. The dart target device according to claim 10, wherein, said second securing means comprises a hook adapted to engage a portion of said dart board.

13. The dart target device according to claim 1, further comprising, means to affect automatic selective rotation of said body member relative to said dart board.

14. The dart target device according to claim 13, wherein, said means to affect selective rotation comprise a motor means having a driven output shaft, wherein said output shaft is selectively operated to enable continuous or intermittent rotation of said body member on said dart board.

15. The dart target device of claim 14, wherein, said motor means is a reversible motor such that body member may be rotated relative to said dart board in either direction dependent on the direction of rotation of said output shaft.

16. A dart target device adapted to be used in conjunction with a dart board comprising:

a body member formed as a substantially wedge-shaped member having dimensions corresponding to a plurality of wedge-shaped target areas formed on said dart board, said body member having first and second ends, with said first end including means to selectively rotatably secure said body member to said dart board, wherein said body member will overlie said plurality of target areas on said dart board when secured to said dart board, said body member further having at least one target area formed thereon.

17. The dart target device according to claim 16, wherein, said dart board has at least first and second target areas formed thereon which comprise double and triple scoring areas, and said body member includes at least two target areas thereon, a first of said target areas on said body member positioned to correspond to said double scoring area of said dart board, and the second of said target areas of said body member positioned to correspond to said triple scoring area of said dart board.

18. The dart target device according to claim 17, wherein, each of said target areas of said body member are dimensioned to be larger than the actual target double or triple scoring target areas of said dart board.

19. The dart target device according to claim 16, further including, a second securing means associated with said second end of said body member adapted to selectively engage said dart board at said second end to maintain the position of said second end t the desired rotational position of said body member.

20. The dart target device according to claim 16, wherein, pg,23 said body member has dimensions corresponding to at least three of said wedge-shaped target areas formed on said dart board.

* * * * *